US005216396A

United States Patent [19]

Stahly

[11] Patent Number: 5,216,396

[45] Date of Patent: Jun. 1, 1993

[54] SWITCHING RELAY

[75] Inventor: Daniel C. Stahly, Elmhurst, Ill.

[73] Assignee: Eaton Corporation, Cleveland, Ohio

[21] Appl. No.: 759,331

[22] Filed: Sep. 13, 1991

[51] Int. Cl.[5] ..... H01H 51/22

[52] U.S. Cl. ..... 335/80; 335/78; 335/128

[58] Field of Search ..... 335/78-86, 335/124, 128, 130-133

[56] References Cited

U.S. PATENT DOCUMENTS

| | | | |
|---|---|---|---|
| 3,950,718 | 4/1976 | Nagamoto | 335/79 |
| 4,356,465 | 10/1982 | Agatahama | 335/128 |
| 4,370,138 | 2/1986 | Motoyama et al. | 335/80 |
| 4,689,587 | 8/1987 | Shroeder | 335/128 |
| 4,707,675 | 11/1987 | Motoyama et al. | 335/130 |
| 4,831,348 | 5/1989 | Agatahama et al. | 335/80 |

*Primary Examiner*—Lincoln Donovan
*Attorney, Agent, or Firm*—R. A. Johnston

[57] ABSTRACT

A compact low profile relay fabricated upon a base such as a printed circuit board. A pole piece having a ceramic coating with overlain conductive polymer strips serves as bus bar for coil connection. Spaced ferromagnetic core portions are formed integrally with the pole piece for plural coils which each lie flat when received over a core portion. A generally U-shaped armature is received over each core with the open ends of the legs of the U-shape contacting and pivoted against the pole piece for completing a magnetic loop therewith. Upon energization of the coil, the U-shaped armature passes the end of the coil to effect movement of a switch blade arm to effect switching a pair of load current contacts.

18 Claims, 2 Drawing Sheets

SWITCHING RELAY

BACKGROUND OF THE INVENTION

The present invention relates to devices for switching a load current by movement of a movable switching member to effect making and breaking of a set of electrical contacts. The present invention relates particularly to switching devices of the type employing an electromagnetic actuator for effecting the movement of the movable switch member; and, particularly relates to relays having an armature magnetically moved by electrical energization of a coiled conductor such as a solenoid.

Where it is required to provide a relay for switching a substantial load current in association with an electronic control circuit, it has been desired for simplicity in high-volume manufacturing to provide the relay as part of the fabrication of the circuit as, for example, built up on a printed circuit board. For applications in which space or volume is limited, it has been desired to provide such a relay and base, such as a printed circuit board combination with a minimum volume for installation in appliances controlled by the electronic circuit. Such an arrangement is desirable from a manufacturing standpoint because it is less costly to fabricate the relay as part of the printed circuit board, thereby eliminating the handling and separate attachment and wiring of a relay to the printed circuit board.

It has further been desired to provide a built-up or base-mounted relay such as for a printed circuit with a minimum volume and generally flat configuration, yet provide sufficient switching power to the relay to enable making and breaking of a set of contacts capable of handling substantial load currents, yet requiring only a very small current to the relay coil for effecting switching. Heretofore, printed circuit board mounted relays have had an overall bulkiness and awkward configuration due to the amount of ferromagnetic pole material required to provide sufficient magnetic flux to produce adequate relay actuating force with the low electrical current as, for example, the current provided by low voltage solid state signal transistors, for driving the relay coil. It has thus been desirable to find a way or means of providing a compact, low current relay which may be built upon or fabricated on a base, such as a printed circuit board, and which is capable of switching a set of contacts for handling a substantial load current, and to provide such a device which is low in manufacturing cost, to facilitate high volume mass production.

SUMMARY OF THE INVENTION

The present invention provides a simple, compact, and economical low current relay built-up or fabricated integrally on a base structure as, for example, a printed circuit board, in which the relay has a compact, generally flat configuration with respect to the surface of the base upon which it is fabricated. The relay employs an electromagnetic actuator having a coil and movable armature for effecting movement of a movable switch blade which, upon energization and de-energization of the coil, causes making and breaking of a set of load current carrying contacts.

The relay has a stationary ferromagnetic pole piece attached to the base with an integrally formed core portion extending therefrom in a direction generally parallel to the surface of the base; and, a coil is received over the core portion. A generally flat U-shaped armature has the open ends thereof pivoted on the pole piece to complete a magnetic flux loop therewith. Upon energization of the coil, the closed end of the armature is movable about the end of the coil for effecting movement of a movable switch member cantilevered at the base.

The pole piece is formed of ferromagnetic material and has a layer of insulating material provided on a surface thereof electrical conductor strips formed of a relatively thin film of conductive material laid thereon which has the coil leads attached thereto; and, the conductive strips are adapted for external electrical connection. The construction of the relay of the present invention lends itself particularly to applications where the base comprises a printed circuit board. The pole piece including the core portion and the armature may be conveniently be formed of flat sheet stock, and upon build up on a printed circuit board, provide a compact, flat arrangement with sufficient ferromagnetic material to enable a small low current coil to effect the desired switching of a movable blade arm having relatively large load current contacts.

The relay of the present invention is particularly suitable for printed circuit board bases because the coil leads are attached directly to the pole piece, rather than on a printed circuit board, which provides for convenience of external electrical attachment to the printed circuit board and relay. The pole piece preferably has a ceramic coating of insulating material thereover, upon which a polymer film conductive strip is laid to provide for attachment of the coil leads thereto, and external lead attachment thereto. The construction of the present relay lends itself particularly to an arrangement whereby the pole piece has an elongated configuration, with a plurality of spaced core portions extending therefrom to permit a plurality of coils and U-shaped armatures to be disposed therealong, thus providing plural relays on a common base or printed circuit board. In such a plural coil arrangement, the conductive strip on the elongated pole piece serves conveniently as a bus bar for the plurality of coils.

DETAILED DESCRIPTION

Figure 1:
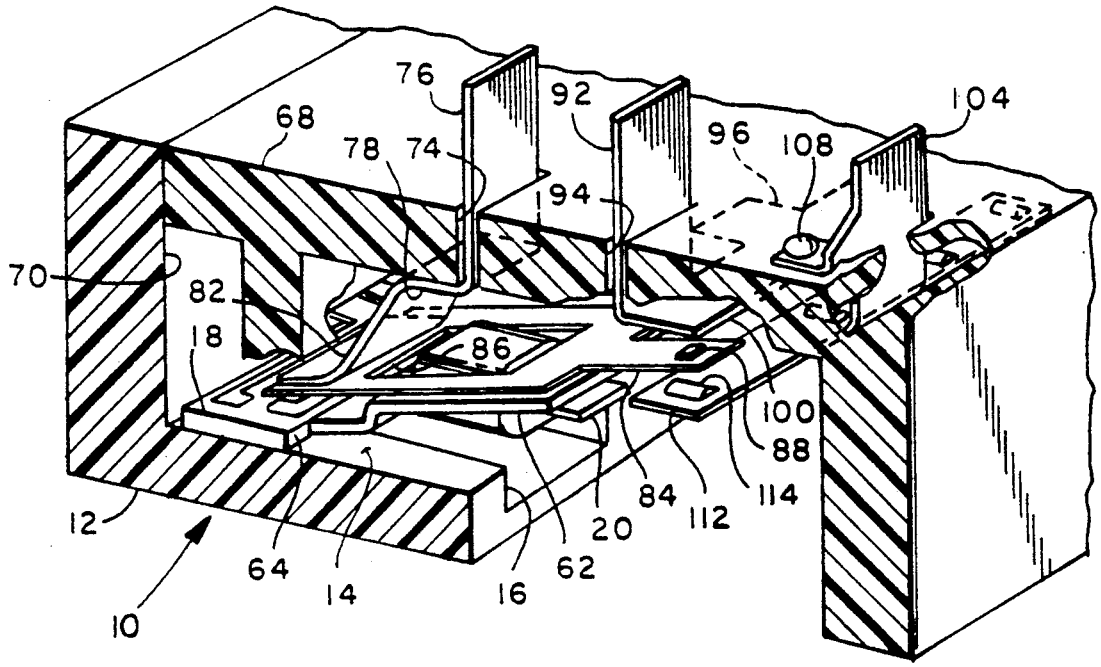
FIG. 1 is a somewhat perspective view of the assembled relay on the base.
Figure 2:
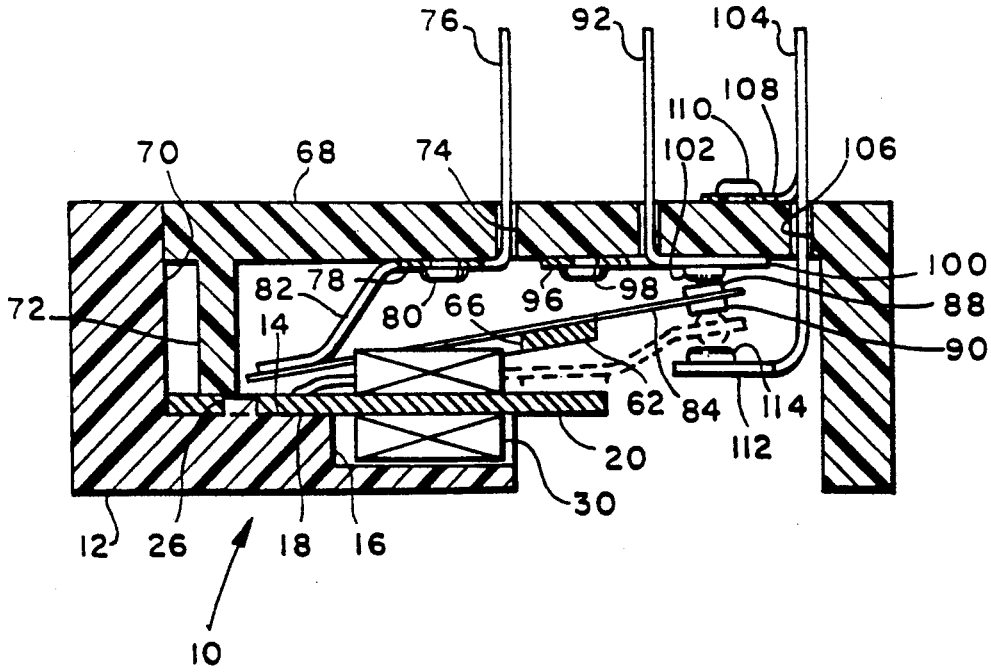
FIG. 2 is a sectional view taken through the axis of the coil of the relay of FIG. 1.

Referring to FIGS. 1 and 2, the assembled switching relay is indicated generally at 10 has having a base 12 formed of electrically non-conductive or insulating material such as, for example, the material from which printed circuit boards are made, and which has a generally flat upper surface 14 upon which the switching components are mounted, and which has a recess or depression 16 formed therein for accommodating the components of the relay as will hereinafter be described.

Figure 3:
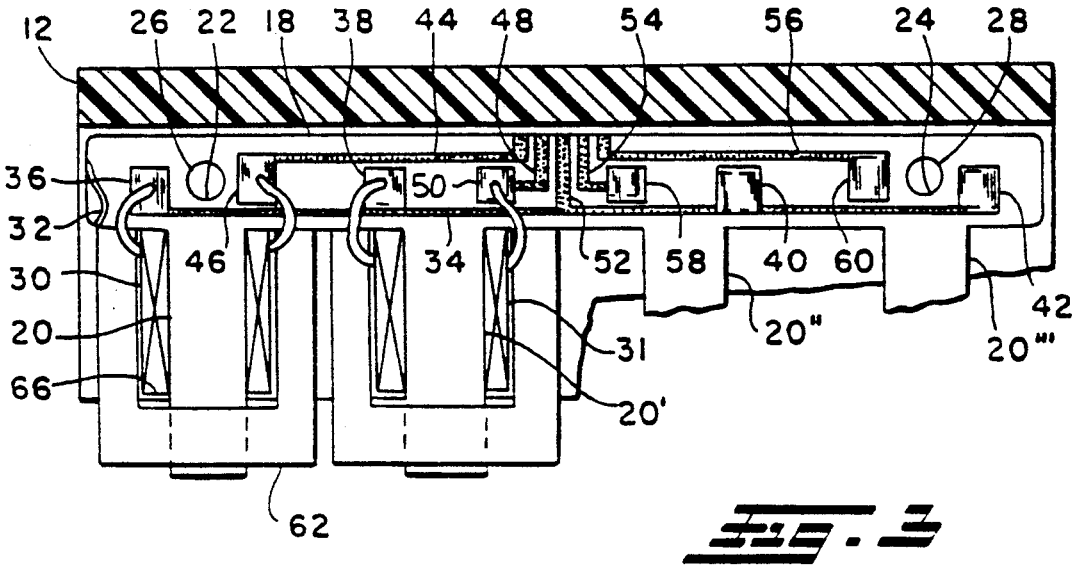
FIG. 3 is a plan view of the pole piece of the relay of FIG. 1.

Referring to FIGS. 1, 2, and 3, a pole piece 18 composed of ferromagnetic material having a generally elongated configuration is provided with at least one, and preferably a plurality, of spaced core portions 20 formed integrally therewith and extending outwardly therefrom in planar arrangement in a direction transverse to the direction of elongation. The core portions are denoted by reference numerals 20,20', 20'', and 20''' in FIG. 3. In the presently preferred practice of the invention, the pole piece 18 and core portions are formed integrally from sheet stock for ease of fabrication in high volume production. The pole piece has apertures 22,24 respectively provided adjacent opposite ends thereof for receiving therein suitable locating posts provided on the base, such as the post denoted by reference numeral 26 and 28 in FIG. 2.

Referring to FIGS. 1, 2, and 3, at least one, and preferably a plurality of electrical coils, two of which are shown and denoted by reference numerals 30,31, are received respectively over the core portions 20,20' with the axis of the coil thereby disposed generally parallel to the surface 14 of the base. The lower portion of each of the coils 20 is received in a groove 16 provided in the base 12, and one of these grooves is illustrated by reference numeral 16. It will be understood that a groove is provided in the base for each coil; and, that the coils for core portions 20'' and 20''' have been omitted in FIG. 3 for brevity.

The pole piece or bus bar 18 has the upper surface thereof coated with a thin layer of insulating material as, for example, ceramic material denoted by reference numeral 32 in FIG. 3. In the presently preferred practice of the invention, the ceramic coating has a thickness on the order of 0.15 mm. The ceramic material provides a substrate or base for strips of thin conductive material which may comprise as, for example, polymeric conductive film material, and which are deposited on the insulating material 32 in the form of a common strip 34 having pad portions 36 and 38 provided thereon in longitudinally spaced arrangement respectively adjacent the coils 30 and 31. Additional pad portions 40,42 are provided in spaced arrangement and adjacent the coil core portions 20'',20''' respectively. A separate strip 44 is provided in generally parallel relationship to the common strip 34; and, the strip 44 has a pad portion 46 formed at the end thereof adjacent the coil 30. Similarly, a separate strip 48 is provided and has a pad portion 50 provided adjacent coil 31 with the ends of the strips 44 and 48 turned at right angles to terminate adjacent the edge of the bus bar 18. A tying strip 52 extends from the common strip 34 and terminates adjacent the edge of the bus bar 18. Separate strips 54,56 are provided with end pads respectively 58,60 for core portions 20'',20''' respectively. The strips 54,56 are also turned to terminate adjacent the edge of the bus bar 18 to facilitate external connection thereto.

It will be understood that the leads for the ends of the coil 20 are attached by suitable expedient as, for example, soldering respectively to the pads of electrically conducting material 36,46 to provide circuit connection to the coil. Similarly, the ends of the coil 31 are connected respectively to pads 38 and 50 to permit external electrical connection to the coil 31 via common strip 52 and strip 48.

A generally U-shaped ferromagnetic armature 62 is disposed with the open ends of the legs thereof pivoted on the pole piece 18. In the embodiment shown in FIGS. 1, 2, and 3 the open ends of the U-shape are registered pivotally against the edge 64 of the pole piece 18 for vertical pivotal movement thereabout. As shown in FIGS. 1 and 3, the opposite legs of the U-shaped armature 62 straddle the coil 30; and, the closed end portion 66 of the armature 62 clears the end of the coil 20.

Referring to FIGS. 1 and 2, a cover 68 formed of a suitable insulating material is received over the armature and has the edge thereof contacting the inside surface 70 of the upright portion of the base 12. The cover 68 has a depending rib 72, which registers against the upper surface of the pole piece 18 and retains the pole piece in position on the posts 22,24 provided on the base. Cover 68 has an elongated aperture 74 provided therein which has received therethrough an electrical terminal connector 76 which has a right angled portion 78 formed along the undersurface of the cover, and which is retained in position thereon by a riveted stud 80 which passes through an aperture formed in the portion 78 of the terminal. The right angle portion of the terminal also has a downwardly extending depending portion 82, which extends in close proximity to the pivoted end of armature 62.

The depending portion 82 of the terminal 76 has attached thereto, by any suitable expedient as, for example, weldment, a generally flat-spring switch blade arm 84, which has a cut-out 86 provided therein to permit passage of the coil thereinto. A pair of electrical contacts 88,90 are provided at the end of blade 84 with one contact disposed on each opposite side of the blade. The depending portion 82 of the electrical terminal 76 thus provides a suspension for locating and holding the switch contact arm in cantilever arrangement therefrom, and in juxtaposition to the armature 62.

The closed end of armature 62 is secured to blade arm 84 by any suitable expedient such as, for example, weldment. A second electrical connector terminal 92 extends upwardly through another aperture 94 provided in the cover. The terminal 92 has a tab portion 96 bent at right angles thereto and secured to the undersurface of cover 68 by an integrally formed stud 98 received through an aperture in the tab 96 and riveted thereover. Terminal 92 also has a flange 100 formed generally at right angles thereto along the undersurface of cover 68 and extending in a direction opposite to the tab 96. The flange 100 has mounted thereon stationary electrical contact 102, which is disposed and located directly above the contact 88 on the switch blade 84.

A third electrical connecting terminal 104 is provided and extends upwardly through an aperture 106 formed in the cover 68; and, terminal 104 is secured by a tab 108 formed at right angles thereto which is curled retained the upper surface of the cover 68 by integrally formed stud 110, which is received through an aperture therein and deformed thereover to provide a rivet. Terminal 104 extends downwardly through the aperture 106, and has a flange 112 formed at generally right angles thereto, and extending beneath the switch contact arm 84. Flange 112 has a stationary contact 114 provided thereon and disposed directly beneath and spaced from the contact 90 on the switch blade 84.

It will be understood that the switch contact blade 84 is biased to the upward position shown in solid outline in FIG. 2 such that contact 88 is closed against contact 102, thereby completing a circuit between terminals 76 and 92. Upon energization of the coil 30, armature 62 is attracted downwardly by the magnetomotive force developed in the core 20, and moves to the position shown in dashed outline in FIG. 2 causing contact arm 84 to move downwardly, breaking the circuit between contacts 102 and 88, and closing contact 90 against contact 114 to complete the circuit between electrical terminals 76 and 104. The operation of the relay illustrated is thus that of a single-pole double-throw switch.

It will be understood that although only a single coil and armature is illustrated in FIGS. 1 and 2, where a plurality of coils are employed as shown in FIG. 3, the switching terminal arrangement is repeated for each armature and contact blade arm.

Figure 4:
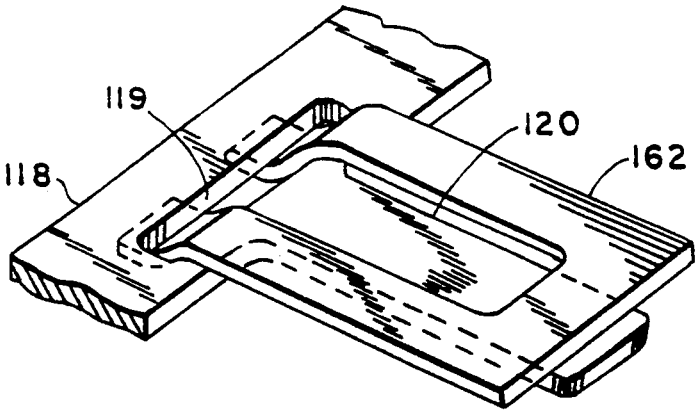
FIG. 4 is a somewhat perspective view of an alternate arrangement of the armature of the relay of FIG. 1.

Referring to FIG. 4, an alternate embodiment is illustrated, wherein the pole piece 118 has an elongated slot 119 formed therein, with a coil core portion 120 formed integrally therewith, and extending therefrom, in a manner similar to the core portion 20 of the pole piece 18. An armature 162 has a generally U-shaped configuration similar to that of armature 62, and has the open ends of the legs thereof offset, or "S" shaped in side view, and received in the slot 119 for retaining the armature on the pole piece 118 and permitting pivotal movement therein.

The present invention thus provides a unique and novel contact switching relay built up or fabricated on a base as, for example, a printed circuit board, which enables low current solid state switching devices to actuate an electromagnetically operated switch for switching heavy load currents, and yet provides a compact and easy to manufacture assembly on the base. The relay of the present invention has a compact low profile configuration, yet provides sufficient ferromagnetic material to enable adequate magnetomotive forces from a low current coil to actuate electrical contacts capable of carrying substantial load current.

Although the invention has been described hereinabove with respect to the illustrated embodiments, it will be understood that the invention is capable of modification and variation, and is limited only by the scope of the following claims.

I claim:

1. A switching relay comprising:

(a) base means formed of electrically non-conducting material;

(b) a bus bar attached to the surface of said base means, said bus bar formed of ferromagnetic material generally thin with respect to its width and having a coating of electrically non-conductive material, said bus bar having formed integrally therewith and extending therefrom a core portion;

(c) a coil of electrical conductive material received over said core portion;

(d) a generally U-shaped armature formed of ferromagnetic material with the free ends thereof pivoted against said bus bar with said coil disposed within said U-shape;

(e) movable contact means attached to said armature means, said contact means disposed for movement with said armature means between an actuated and unactuated position;

(f) means biasing said movable contact means toward said unactuated position; and, (g) stationary contact means disposed adjacent said movable contact means and operative to be contacted thereby, wherein, upon flow of electrical current through said coil, said armature means is moved to said actuated position by the magnetomotive force generated in said core and said movable contact means closes against said stationary contact means.

2. A switching relay comprising:

(a) base means;

(b) an elongated pole piece generally thin with respect to its thickness, said pole piece formed of ferromagnetic material coated with an electrically non-conductive coating with a plurality of thin film leads of electrically conductive material deposited on said non-conductive coating, said pole piece having at least one core portion formed integrally therewith and extending therefrom in a direction generally transverse to the direction of elongation;

(c) a generally U-shaped armature having the open ends thereof registered against said pole piece and pivoted thereagainst with said core portion of said pole piece disposed between the legs of said U-shaped armature;

(d) a coil of electrically conductive material disposed with said pole piece core portion extending therewithin therein, said coil having the opposite ends of its conductor connected to said thin film leads on said pole piece;

(e) a movable contact blade mounted for pivotal movement on said base means with a contact thereon said blade having a cut-out therein with said coil positioned therein, whereby, upon electrical energization of said coil, said armature is magnetically pivoted by magnetomotive forces acting thereon; and, (f) stationary contact means operable for making and breaking electrical contact with said movable blade contact upon energization and de-energization of said coil.

3. The relay define in claim 2, wherein said non-conductive coating of said pole piece comprises ceramic material.

4. The relay defined in claim 2, wherein said thin film of electrically conductive material comprises a conductive polymer material.

5. The relay defined in claim 2, wherein said pole piece means has an elongated configuration and has a plurality of spaced core portions formed thereon, each with a coil and U-shaped armature disposed thereover; and, wherein each of said armatures is operative to effect movement of a separate movable contact blade.

6. The relay defined in claim 2, wherein said pole piece is formed of flat sheet stock.

7. The relay defined in claim 2, wherein said movable blade member is formed of flat sheet spring material.

8. The relay defined in claim 2, wherein said stationary contact means comprises a pair of contacts disposed on opposite sides of said movable contact blade.

9. The relay defined in claim 2, wherein said pole piece includes a plurality of spaced core portions, each with a coil disposed thereover and a separate U-shaped armature and pivoted blade member therefor; and, said stationary contact means includes a contact disposed on opposite sides of each of said blade members with the contact on a common side thereof connected to a common bus bar on said base means.

10. The relay defined in claim 2, wherein said pole piece includes a plurality of spaced core portions with a separate coil, U-shaped armature and blade member disposed over each core portion; and, said blade members are attached to a common bus bar on said base means.

11. The relay defined in claim 2, wherein said armature is formed of flat sheet stock.

12. A mounted switching relay comprising:

(a) a bas formed of electrically non-conducting material;

(b) an elongated pole piece mounted on said base and formed of ferromagnetic material with at least one surface thereof coated with ceramic insulating material and having deposited thereon a relatively thin layer of electrically conductive material for forming a circuit lead;

(c) a generally U-shaped armature formed of ferromagnetic material having the open ends of said U-shape pivoted for movement against said pole piece thereby completing a magnetic loop therewith; and, (d) coil means disposed on said base between the opposite legs of said U-shaped armature, said coil means operative to magnetically effect said pivoted armature movement, upon electrical energization thereof and said coil means is electrically connected to said layer of electrically conductive material; and, (e) switch means attached to said base means and operable in response to said pivoted armature movement for making and breaking a set of electrical contacts.

13. The relay defined in claim 12, wherein said pole piece has a core portion thereof extending outwardly therefrom with said coil means received thereover.

14. The relay defined in claim 12 wherein said pole piece has an elongated configuration with a plurality of spaced core portions extending therefrom in a direction transverse to said direction of elongation; and, said coil means includes a plurality of coils with each coil having one of said core portions received centrally therein.

15. A switching relay comprising:

(a) a base of non-magnetic material;

(b) a pole piece formed of a strip of ferromagnetic material and mounted on a surface of said base;

(c) a generally U-shaped armature formed of ferromagnetic material and having the open end portions of said U-shape pivotally registered against the edge of said pole piece and forming a ferromagnetic flux loop with said pole piece;

(d) coil means disposed within said U-shape of said armature with the axis thereof generally parallel to said surface and attached to said base, said coil means operative, upon flow of an electrical current therethrough, to provide a magnetomotive force for causing pivotal movement of said armature; and, (e) switch means responsive to said armature movement to make and break a set of electrical contacts.

16. A method of making and operating a relay comprising the steps of:

(a) providing a base of non-magnetic material;

(b) attaching a ferromagnetic pole piece strip to a surface of said base;

(c) providing a generally U-shaped ferromagnetic armature and pivoting the ends of said armature against the edge of said strip;

(d) disposing a coil on said surface within said U-shape and positioning said coil with the axis thereof generally parallel to said surface;

(e) energizing said coil and magnetically pivoting said armature; and, (f) making and breaking a set of electrical contacts with said armature movement.

17. The method defined in claim 16, wherein the step of disposing a coil includes the steps of coating said pole piece with insulating material, applying a strip of electrically conductive material over said coating; and, attaching the end of the coil conductor to said strip.

18. The method defined in claim 16, wherein said step of making and breaking a set of electrical contacts includes the steps of pivoting a contact blade arm on said base and moving said blade arm with said armature movement.

* * * * *